US006209264B1

(12) United States Patent
D'Abreu

(10) Patent No.: US 6,209,264 B1
(45) Date of Patent: Apr. 3, 2001

(54) DEVICE FOR SUPPORTING AND MOVING A DOOR IN A MULTITUDE OF POSITIONS

(75) Inventor: Garth D'Abreu, Borahamwood (GB)

(73) Assignee: The Curran Company, Glendale Heights, IL (US)

( * ) Notice: Subject to any disclaimer, the term of this patent is extended or adjusted under 35 U.S.C. 154(b) by 0 days.

(21) Appl. No.: 09/226,815

(22) Filed: Jan. 6, 1999

(51) Int. Cl.[7] ..... E05D 5/10; E05F 11/36
(52) U.S. Cl. ..... 49/210; 49/213; 49/358
(58) Field of Search ..... 49/128, 129, 130, 49/358, 209, 210, 211, 213, 216, 221

(56) References Cited

U.S. PATENT DOCUMENTS 2,294,041 * 8/1942 Mims ..... 49/358
3,886,685 * 6/1975 Riphagen ..... 49/209
4,495,729 * 1/1985 Britzke et al. ..... 49/212
4,612,729 * 9/1986 Sato ..... 49/358 X
4,924,625 * 5/1990 Dilcher ..... 49/212
5,036,899 * 8/1991 Mullet ..... 160/189
5,566,505 * 10/1996 Kamezaki ..... 49/225
5,736,671 * 4/1998 Perala et al. ..... 174/35 R
5,852,897 * 12/1998 Sukale ..... 49/358

* cited by examiner

*Primary Examiner*—Daniel P. Stodola
*Assistant Examiner*—Gregory J. Strimbu
(74) *Attorney, Agent, or Firm*—Cherskov & Flaynik

(57) ABSTRACT

A device for suspending and moving a door leaf perpendicular and parallel to a wall. The device comprising a first set of rails extending in a direction perpendicular to the wall, a second set of rails extending in a direction parallel to the wall and an elongated member which extends both parallel to and perpendicular to the wall. The door leaf is slidably mounted on the first set of rails and the first set of rails is slidably mounted on the second set of rails. The door leaf includes a motor which operatively engages the elongated member to move the door leaf perpendicular to the wall and parallel to the wall to open and close an opening in the wall.

19 Claims, 8 Drawing Sheets

DEVICE FOR SUPPORTING AND MOVING A DOOR IN A MULTITUDE OF POSITIONS

BACKGROUND OF THE INVENTION

1. Field of the Invention

This invention relates to a device for opening and closing a door and more specifically, this invention relates to a device to effect multiple movements of a suspended door leaf.

2. Background of the Invention

In an overwhelming majority of situations, a door is opened and closed by hinges along the longitudinal edge of the door. This arrangement has unavoidable disadvantages. Specifically, as the door swings open or shut, the area included in a circular section, the radius of which is equal to the width of the door, must be free of all encumbrances. Longitudinally-hinged configurations also bring problems when thick doors are utilized, inasmuch as thicknesses have to be limited so as to allow clearance of the door edge with the door jamb. This disadvantage is most serious in such situations (shielding of radio frequency radiation or magnetic fields in particular) where one must ensure intimate and continuous contact between the door leaf and the walls of the enclosure or when the door leaf must bear some attachments or equipment that increase the effective thickness of the leaf.

Anechoic chambers are another case in point: the walls of the enclosure, the door leaf included, are covered with cones that normally project inwardly toward the center of the enclosure to distances of one meter or more. The use of much larger cones also is not unusual. Such protrusions makes the use of a door leaf extremely difficult to incorporate in a hinged door arrangement. To overcome this shortcoming, a regular thickness door is employed to initially seal the chamber, but then the door is covered with an absorber trolley containing the inwardly directed cones. As such, providing a door with anechoic surfaces requires two actions, first closing the door and then rolling the trolley in position. The same operation, in reverse, is required when exiting the anechoic room through the door opening.

Hinged door configurations suffer from other drawbacks. Specifically, where the axis of rotation defined by the hinges is vertical, the center of gravity of the door leaf is at some distance from that axis and thus the weight of the door produces a torque that must be counteracted by the hinges. This torque results in a gradual strain on the hinges with concomitant wear and tear of the hinges and misalignment of the door leaf. Also, because of the relatively large momentum of inertia of the edge-supported door leaf around the axis of rotation, motor-effected opening and closing of the leaf is often most cumbersome and expensive.

Finally, hinge-secured door leafs have the further disadvantage that they cannot be moved fully away from the door opening to allow adequate access to the door frame and surrounding elements of the enclosure wall. Examples of hinge secured door leafs include U.S. Pat. Nos. 4,486,980; 4,561,209; 4,953,324; and 5,013,869.

Several attempts have been made to overcome the aforementioned disadvantages in hinge-supported vertical door leafs. One method involves suspending the door from one or more wheels or glides. The wheels or glides are allowed to roll or slide on a horizontal rail to facilitate opening or closing the door. However, this configuration allows motion in only one rectilinear direction, which is perpendicular to the door opening, such movement indeed necessary when the leaf is particularly thick.

Other door configurations include a door leaf suspended from wheels that roll on a curved channel to impart door rotation around a vertical axis as the door is opened or closed. These arrangements suffer from the same disadvantages as hinge-supported doors, particularly when the leaf is more than a certain thickness.

Generally, motion in two rectilinear dimensions has proven to be much more difficult to effect, with multiple sets of rails, wheels or glides required. Heretofore, such arrangements have proven cumbersome especially when one seeks motorized transport of the door leaf inasmuch as two motors and/or a complex shifting mechanism are needed. (See e.g. U.S. Pat. No. 4,691, 581 and U.S. Pat. No. 4,753, 038. In the '038 patent, a door leaf is suspended from a rail which is in turn suspended from a perpendicular rail. The '038 patent requires that the door leaf pivot around a vertical axis and be supported by floor-mounted supports).

Systems, such as the ones discussed above where the door leaf is transported on ground-mounted rails have the additional disadvantage that additional supports must be provided to vertically maintain the door leaf. Also, ground mounted hardware, such as rails, impede access to the door and suffer damage as equipment is rolled over them. U.S. Pat. Nos. 4,644,690 and 4,753,038 disclose doors rolling on floor-mounted rails.

Two-dimensional or "dual movement" door motion is often required to effect unimpeded access to the door opening, particularly when "bulky" door configurations are utilized, such as in MRI- and Anechoic-applications.

A need exists in the art for a simple device to support and transport a door leaf in a plurality of positions. The configuration should be capable of multiple positioning of the leaf when a single channel, a single drive, and a single motor are utilized. The configuration should be particularly accommodating for heavy doors and bulky door designs, such as those incorporating thick dimensions in anechoic applications or movable panels for electromagnetic radiation shielding. The device should also be able to rely on only one means for positioning the door relative to an opening defined by a door jamb.

SUMMARY OF THE INVENTION

It is an object of the present invention to provide a device for supporting and moving a door in a plurality of positions that overcomes the disadvantages of the prior art.

A further object of the invention is to provide a device for a multi-action door leaf. A feature of the present invention is the suspension of a door leaf on rails to allow the leaf to slide perpendicularly relative to a plane defined by a door frame in an enclosure. Another feature is that these same rails are mounted on a carriage which slides over rails parallel to the plane. An advantage of the present invention is that the door leaf moves perpendicular to the door frame and then parallel to the door frame in one continuous motion. Another advantage is that the device accommodates the opening and closing of door leafs integrally formed with anechoic surfaces so that the establishment of an anechoic surface at an opening defining the door jamb is made simultaneously with the door engaging with the door jamb. As such, no need for a separate absorber trolley in conjunction with the door operation is necessary.

Another object of the invention is to provide a device for a dual movement door leaf that employs a single motor. A feature of the present invention is that a single motor removes a door leaf from its jamb using over-head rails by first sliding the leaf perpendicularly from the plane of the wall of an enclosure and then secondly laterally sliding the door leaf parallel to the plane of the wall and away from the door opening. An advantage of the present invention is that a single motor effects the door leaf motion perpendicular to the wall when the door is first opened and then parallel to the wall and conversely when the door is closed. Another advantage is that no floor mounted hardware is required, thereby providing a smooth threshold.

Yet a further object of the invention is to provide a device for maintaining and moving a door in a multitude of positions that employs a single channel and drive chain. A feature of the present invention is that the door leaf is transported by a single motor that engages the longitudinal axis of a single continuous path which deviates by as much as 90 degrees. An advantage of the present invention is that a single motor driven along a continuous drive chain effects door leaf motion in a myriad of directions.

Still another object of the invention is to provide a device for a dual movement door leaf that places minimal stress on the motor and drive chain. A feature of the present invention is that door leaf is suspended from rails that allow the leaf to slide perpendicularly to the plane of the wall of an enclosure while these rails are mounted on a carriage that is free to slide over rails parallel to the plane of the wall. An advantage of the present invention is that weight of the door leaf is not supported by the motor and drive mechanism, thereby minimizing warping and wear and tear of the motor and drive mechanism.

In brief, the invention provides a multi-action door mechanism comprising a door leaf defining a plane; and a single motor attached to said door leaf so as to cause said leaf to move in a multitude of directions relative to the plane.

Also provided is a double-action door comprising a door leaf; a door jamb adapted to receive said door leaf, said doorjamb defining a plane; and a motor attached to said leaf so as to cause said leaf to disengage from said jamb by first moving said leaf perpendicular to the plane and then moving said leaf parallel to the plane.

BRIEF DESCRIPTION OF THE DRAWING

The present invention together with the above and other objects and advantages may best be understood from the following detailed description of the embodiment of the invention illustrated in the drawing, wherein.

DETAILED DESCRIPTION

The present invention provides a device for supporting and moving from above a door leaf wherein a single channel, a single motor, and a single drive acting on a single drive chain are utilized to move the leaf perpendicular to the door opening and also parallel thereto. The single drive can be actuated in a myriad of ways, including, but not limited to electrical actuation and pneumatic actuation.

While the movement from perpendicular motion to parallel motion is continuous, the movement also can be interrupted anywhere along the arc defined by right angle which defines the extremes of the door leaf movement.

Overall Design

Figure 1:
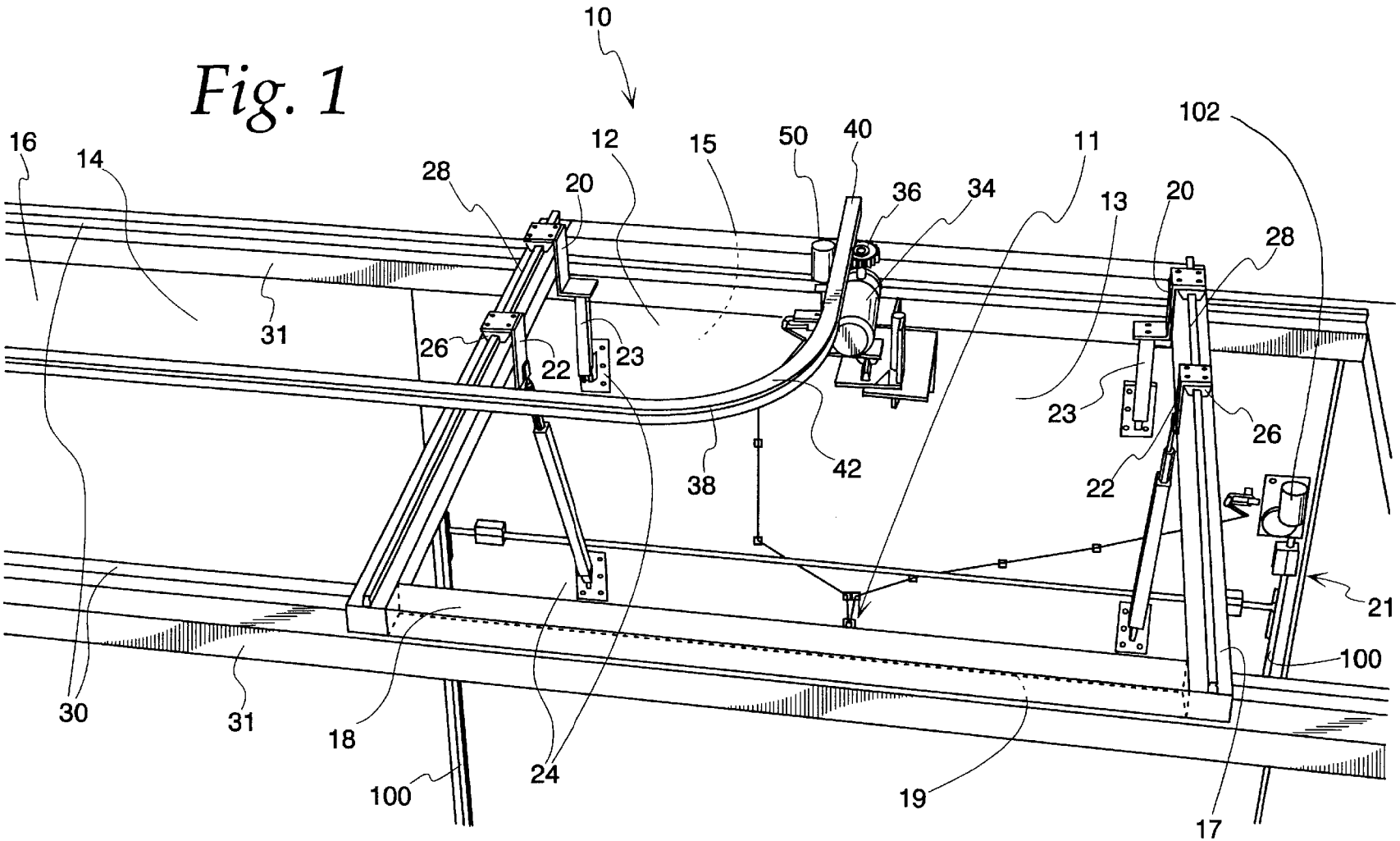
FIG. 1 is a perspective view of an exemplary embodiment of the device, in accordance with features of the present invention.

FIG. 1 provides an overall view of the manner in which a door leaf is supported and transported according to the present invention. The sliding door mechanism is referenced by the numeral 10. A door leaf 12, having a first surface 13 and a second surface 15, is shown in the position where the door leaf covers an opening (not shown) in the wall 14 of the enclosure 16. The door leaf 12 is suspended from a carriage 18 by means of vertical support (i.e. hanging) bracket assemblies 20 and secondary stabilization brackets 22, with both types of brackets attached to the door leaf by means of door-mounted brackets 24. The support brackets 20 and the secondary stabilization brackets 22 rest on glides 26 adapted to slide on a first set of rails 28. The first rails 28 extend in a direction that is generally perpendicular to the door leaf 12 so as to allow the door leaf 12 to slide in a direction generally perpendicular to the wall 14. The carriage 18 is slidably positioned on a second set of rails 30 that are parallel to the surface of the wall 14 of the enclosure 16. Movement of the carriage 18 on the rails 30 facilitates lateral movement of the door leaf 12, i.e. in a direction generally parallel to the plane of the leaf 12. These second set of rails 30 are anchored to a manifold of suitable beams that is itself anchored to the wall 14 or freely standing on the floor.

Movement of the door leaf may be effected either manually or by means of a motorized assembly that is mounted on the first surface 13 of the door leaf 12, whereby the first surface directly opposes the carriage 18 and the rail assemblies 28 and 30. A suitable (e.g. 3 phase, 0.3 kW) motor 34 rotates a sprocket 36 that engages a complementary surface 38 mounted upon a channel 40. While generally elongate, the longitudinal axis of the channel 40 deviates in a predetermined configuration. In the embodiment shown, the channel 40 effects a right angle bend 42 where it is intended for the door leaf 12 to begin altering its perpendicular direction of motion to a parallel direction of motion relative to the plane defined the door leaf. The channel 40 is anchored to the wall 14 at a point above the door opening and/or to the manifold supporting the second set of rails 30. The action of the sprocket 36 advancing along the complimentary surface 38 provides the generally perpendicular and parallel motion of the door leaf as discussed above.

FIG. 1 also depicts a latching assembly 21 for latching the door leaf 12 in place as well as a safety/escape system assembly 11.

Door Suspension Mechanism.

Figure 2:
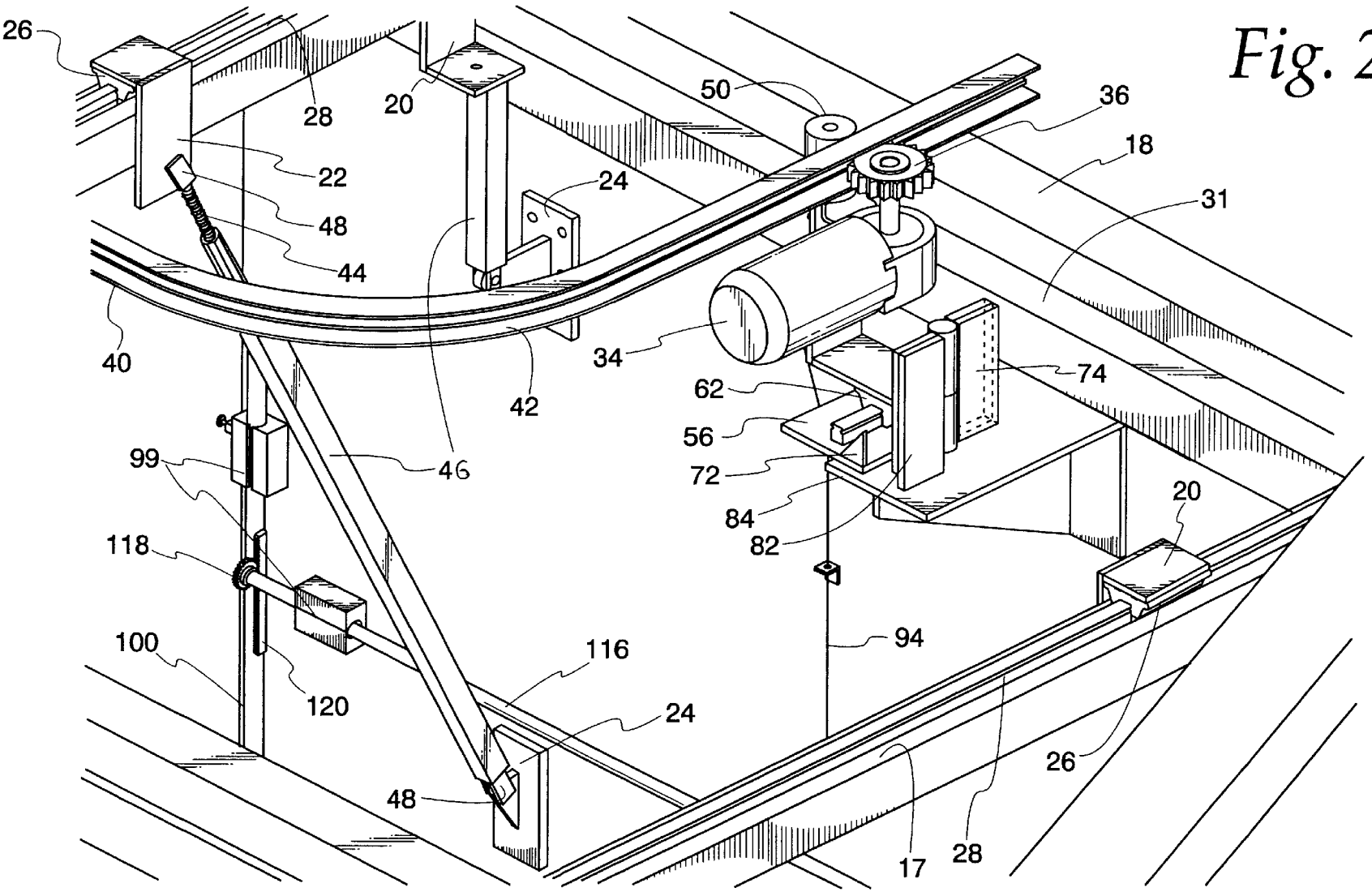
FIG. 2 is a perspective view of motor and leaf-actuating system of the device, in accordance with features of the invention.

A salient feature of the invention is that the door leaf is suspended from above without the need for floor mounted hardware. The orthogonal configuration of the carriage 18 allows very accurate and reproducible movement of the door leaf, vertically as well as horizontally. A first set of surfaces 17 of the carriage 18 is provided to extend perpendicular to the plane defined by the wall 16. These first set of surfaces 17 support a first set of rails 28 extending coaxially therewith. A second set of surfaces 19, extending in a generally parallel direction relative to the enclosure wall 16, slidably receives the second set of rails 30. The second set of rails 30 are supported on an immovable substrate 31 which extends parallel to the plane defined by the enclosure walls FIG. 2 shows a detailed view of the door suspension mechanism.

The vertical support brackets 20 and the secondary brackets 22 are attached to the glides 26 so as to allow the brackets to slidably communicate with the first rail set 28. While two rails are illustrated, other rails can be added or just one rail may be utilized, depending on the weight or size of the leaf or panel to be moved. The rails 28 are mounted on the carriage 18 which itself moves in tandem with the leaf 12. The vertical support brackets 20 are each affixed to a door-mounted bracket 24 by means comprising a Clevis mount 48 and a vertical member 23. The stabilization brackets 22 communicate with a door-mounted bracket 24 (see FIG. 1) via an elongated member comprising a rod, threadably received by a turnbuckle 46. The elongated member, positioned so as to generally form an upwardly directed, ever widening acute angle relative to the door, is terminated at each end with a Clevis mount 48 to facilitate hingeable attachment of the elongated member to the stabilization bracket 22 and the door-mounted bracket 24. The turnbuckles 46 allow adjustment of the load of the door leaf 12 supported by the stabilization brackets and thus ensure proper vertical orientation of the door leaf and minimal load and stress on the motor 34 and motor assembly.

A variety of means may be employed to effect the sliding movement of the door leaf on the rails and in and out of engagement of its door frame. For example, wheels mounted on the brackets 20 and 22 and allowed to roll on tracks designed to receive such wheels constitute an alternative to the glides 26, especially for a massive door leaf. The glides 26 illustrated in FIG. 2 conform very precisely to the cross-section of the rails 28, 30, thus maximizing the area of contact between the glides and the rails in both lateral and in both vertical directions. Thus the glides 26 confer the advantage of limiting wobble and swaying of the door leaf and ensuring that the door leaf will not seek to overshoot past the bend 42 in the channel 40. Moreover, the glides 26 may be supplemented with roller bearings if less friction is desired, and such friction may be made adjustable by installing screw-adjustable brakes on the glides.

Motor Suspension and Drive Mechanism.

Figure 3:
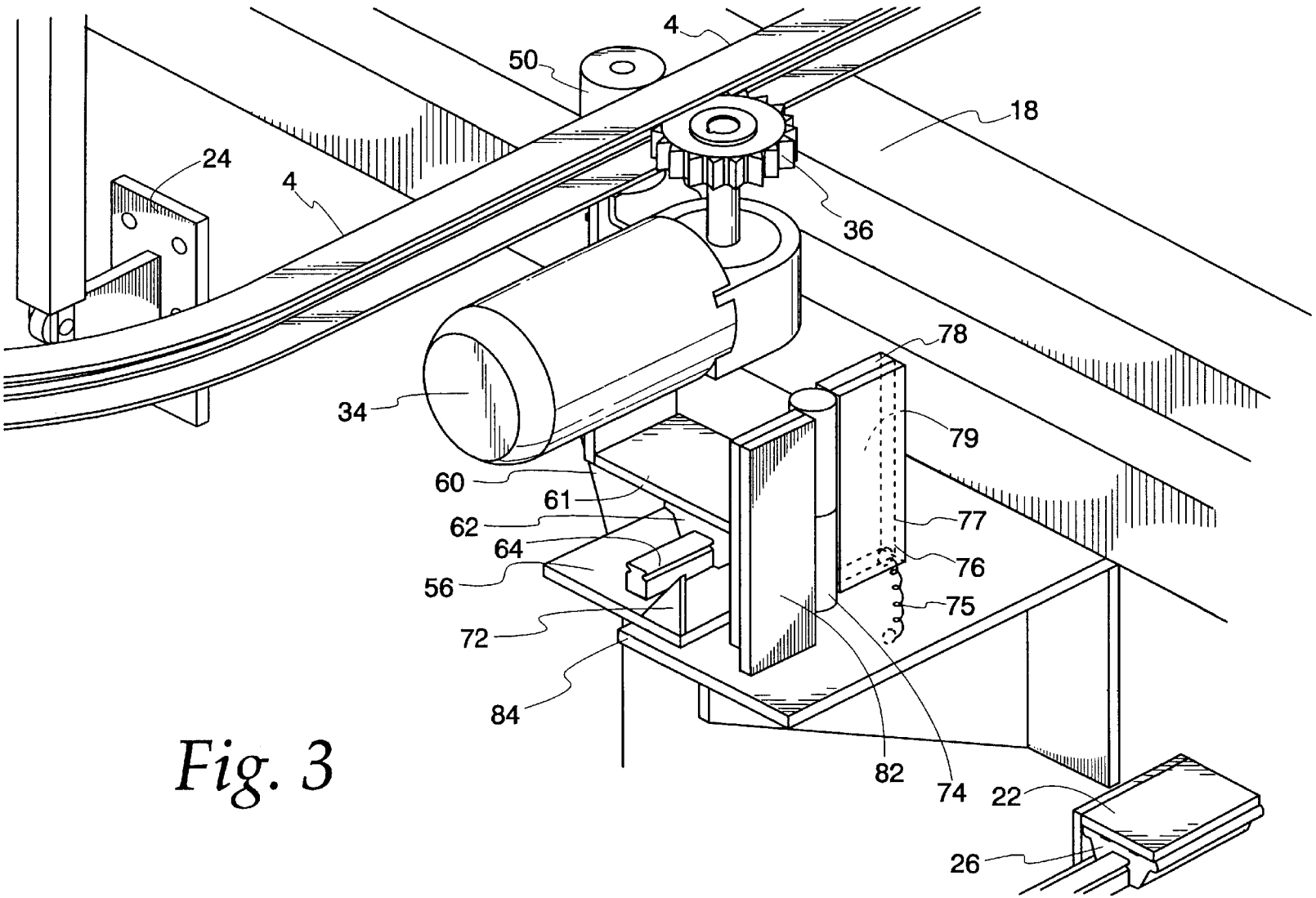
FIG. 3 is a detailed view of the leaf-actuating, motor mount assembly.

The method for suspending the motor 34 and transporting the door leaf 12 is illustrated in FIGS. 2 and 3. As noted supra, the instant configuration is unique inasmuch as the door leaf 12 is activated from complete door closure to complete door clearance by a single motor acting on a single drive path, such as a chain configured to a predetermined shape. The drive sprocket 36 is energized by the motor 34 and is engaged by and acts upon the complimentary surface (e.g., a drive chain) 38 mounted in the channel 40. Thus, when a predetermined voltage is applied to the motor, the sprocket 36 acts upon the complimentary surface 38 with the resulting reaction causing the entire door leaf to either engage or disengage with the door frame. A voltage of the opposite polarity causes leaf movement in the opposite direction. A pinch roller 50 situated so as to confine a portion of the channel 40 between the sprocket 36 and the roller, allows for stable contact between the drive sprocket 36 and the complementary surface 38.

As shown in FIG. 3, the motor 34 itself is mounted on a hinge assembly 52. This hinge assembly 52 allows the sprocket 36 to negotiate the curve at the channel bend 42 while the pinch roller 50 biases the sprocket to mesh with complementary surface 38 contained in the channel 40. Also, the hinge assembly 52 allows the motor to be decoupled from the track in emergencies or whenever necessary. The door leaf also may be actuated manually once the motor is decoupled.

Figure 4:
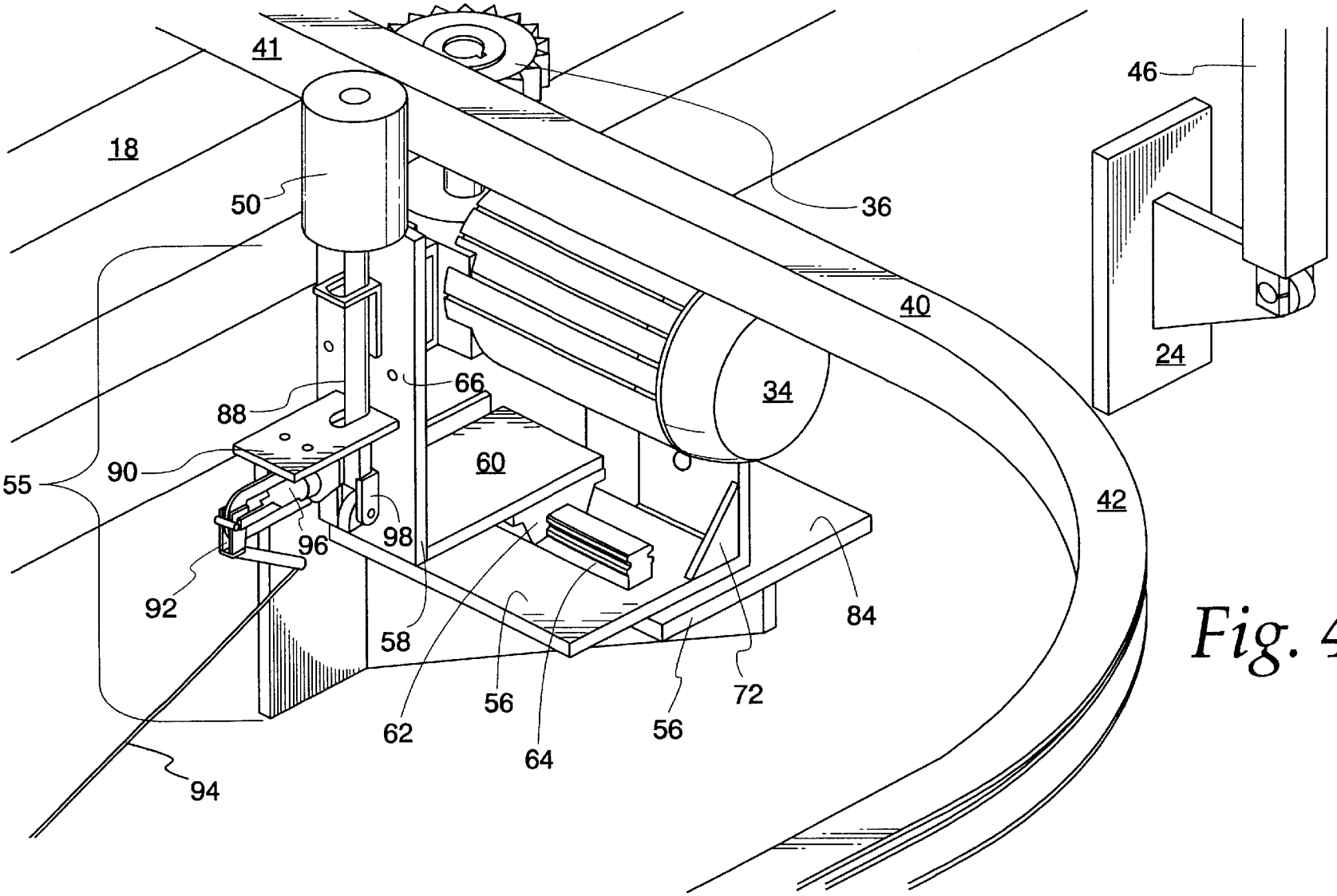
FIG. 4 is a view of FIG. 3 taken along line 4—4.

As shown in greater detail in FIGS. 3 and 4, the motor 34 communicates with the drive sprocket 36 via a rotatable motor shaft 54. The motor 34 is attached to a mounting generally designated as 55. The mounting 55 comprises a platform 56 and a lag plate 58 formed at a right angle so that two portions of the lag plate form two planes that are at 90 degrees from each other. A first laterally extending portion 60 of the lag plate slidably communicates with the platform 56 in a direction perpendicular to the door leaf and via an adjacently disposed interaction between a linear carriage 62 and a linear way 64. The linear carriage 62 is attached to a depending surface 61 of the lag plate while the linear way is attached to the platform 56. This slidable feature accommodates closure of a door leaf for a variety of leaf thicknesses, jamb thicknesses, and door-jamb contact requirements. An end stop plate 72 limits the sliding motion.

An inwardly (i.e. medially) facing surface 68 of the upwardly extending portion 66 of the lag plate 58 directly supports the motor 34, while an opposing (laterally) facing surface 70 supports the pinch roller 50.

This motor-pinch roller mounting configuration facilitates the positioning of the channel 40 intermediate to the roller 50 and the motor 34, as discussed supra.

To maximize contact of the sprocket 36 to the complementary surface 38 in the channel 40, particularly when the channel changes direction, the mounting 55 further comprises a means for laterally varying the position of the motor 34 vis-a-vis the longitudinal axis of the channel 40. This lateral varying means comprises a hinge 74 (FIG. 3) having its longitudinal axis parallel to the door leaf 12. A first side 76 of the to hinge, proximal to the door leaf 12 is attached to an upwardly extending portion 78 of the platform 56, while a second side 80 of the hinge, distal to the door leaf, is attached to an upwardly extending portion 82 of a platform resting surface 84.

Motor Decouplina Mechanism

To facilitate manual operation of the door, also provided is a means for decoupling the door-leaf actuating sprocket 36 from the channel 40. This decoupling means, illustrated in FIG. 4, includes a toggle clamp 92, actuated by a safety cord 94. The toggle clamp is comprised of a plunger 96 juxtaposed so that when the plunger extends medially (i.e., toward the motor drive assembly), the plunger contacts a shaft 88 rotatably receiving and supporting the pinch roller 50.

Upon actuation of the safety cord 94, the plunger 96 is extended outwardly and against a surface of the pinch roll shaft 88 proximal to the clevis mount 98. This action causes the lag plate 58 to become displaced outwardly, and towards the motor 34, thereby causing similar displacement of the motor assembly platform 56 in a direction toward a longitudinal edge of the door and away from the center line of the motor assembly, with the center line defined by the channel 40. As a result of these actions, the sprocket 36 disengages from the channel 40. To more fully disengage the sprocket from the channel, the motor platform 56 can be spring biased toward the longitudinal edge of the door leaf, (i.e., and therefore in a direction perpendicular from the longitudinal axis of the channel 40. As depicted in FIG. 3, this spring biasing can be effected by a spring 75, having a first end attached to the first or proximal side 76 of the motor mount hinge 74 and a second end attached to the motor mount platform surface 84. The spring is attached to a laterally facing surface 77 of the proximal side of the hinge. When the sprocket 36 is fully engaged with the channel 40, the spring 75 is in an extended mode. However, when the toggle clamp 92 is actuated, the plunger from the clamp serves to move the motor mount platform 56 laterally (i.e., in a direction perpendicular to and away from the point on the longitudinal axis of channel 40 at which the sprocket is engaged). This plunger action facilitates the retractable characteristic of the spring and therefore facilitates axial movement of the motor platform relative to the hinge 74 a sufficient distance to decouple the sprocket 36 from the channel 40. Aside from a retractable spring mechanism, a compressive spring can be utilized to facilitate sprocket decoupling. In such an arrangement, a medially facing surface 79 of the upwardly extending portion 78 of the motor platform 56 is contacted with a first end of the compressive spring while the second end of the compressed spring is attached to the platform support surface at a region intermediate the upwardly extending portion and the motor 34. In this alternate spring biased configuration, the sprocket is pushed away from the channel by the spring.

Door Latching Mechanism

A myriad of mechanisms for maintaining the door leaf engaged with its door frame are possible, and well known in the art. However, FIGS. 5–8 depict an exemplary double-latching configuration unique to the industry. This door latching mechanism operates separate from the main door leaf drive, discussed supra, and in essence serves as a supplemental means for actuating the door leaf perpendicularly to the wall to effect an intimate seal between the leaf and the door jamb.

Figure 5:
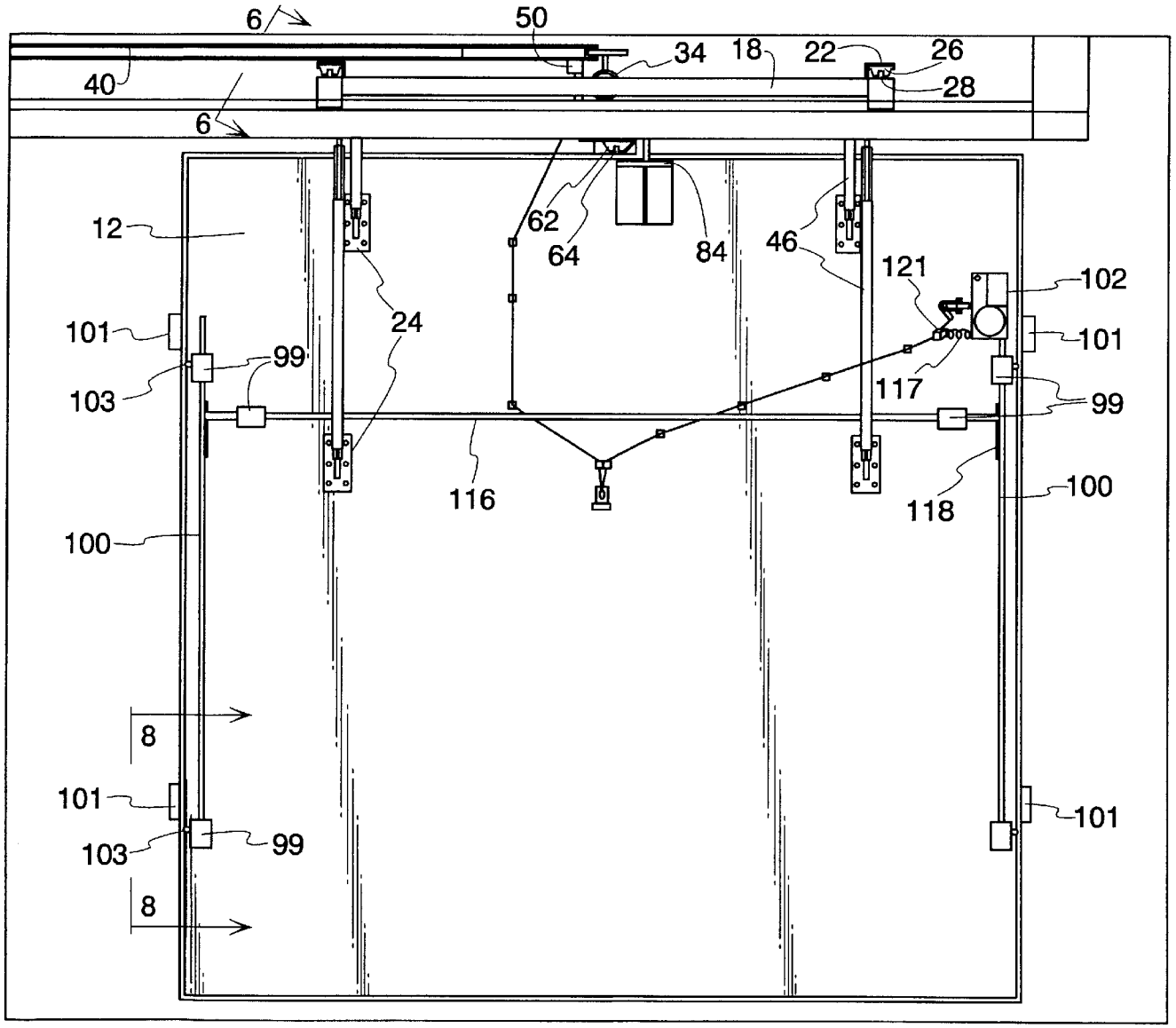
FIG. 5 gives an overall view of the door latching mechanism.

FIG. 5 presents an overview of the door latching mechanism as well as the door-leaf drive mechanism. The door latching mechanism is effected by communication of latch shafts 100 with latch block assemblies 101, the later of which are anchored to the wall of the enclosure. The latch shafts 100 are slidably attached to the door leaf 12 via latch shaft guide ways 99 which are in turn attached to the door leaf.

Each of the latch shafts 100 interact with the latch block assemblies 101 via one or more protuberances 103 which are attached to and laterally extending from the latch shaft 100. The protuberances 103 are arranged to slidably engage and disengage with each of the latch blocks upon axial actuation of the latch shaft 100. The instant configuration depicts the latch shafts 100 at the periphery of the door leaf defined by the longitudinal edges of the door leaf. However, it should be appreciated that the latch shafts 100 can be similarly arranged so as to extend parallel to, and generally situated at, the horizontal edges of the door leaf. Detailed description of the latch-block mechanism is depicted in FIG. 7.

Figure 6:
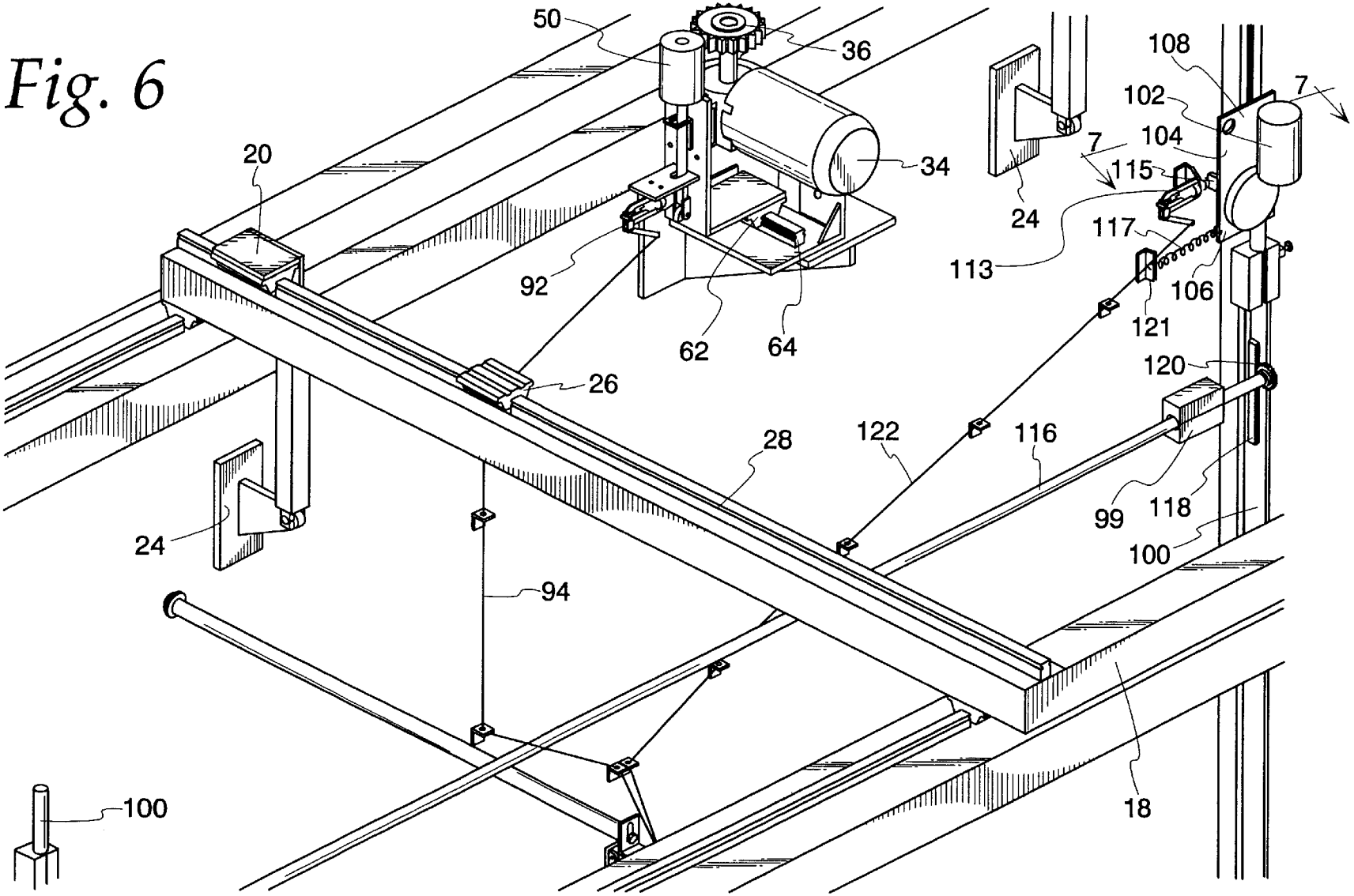
FIG. 6 is a view of FIG. 5 taken along line 6—6.
Figure 7:
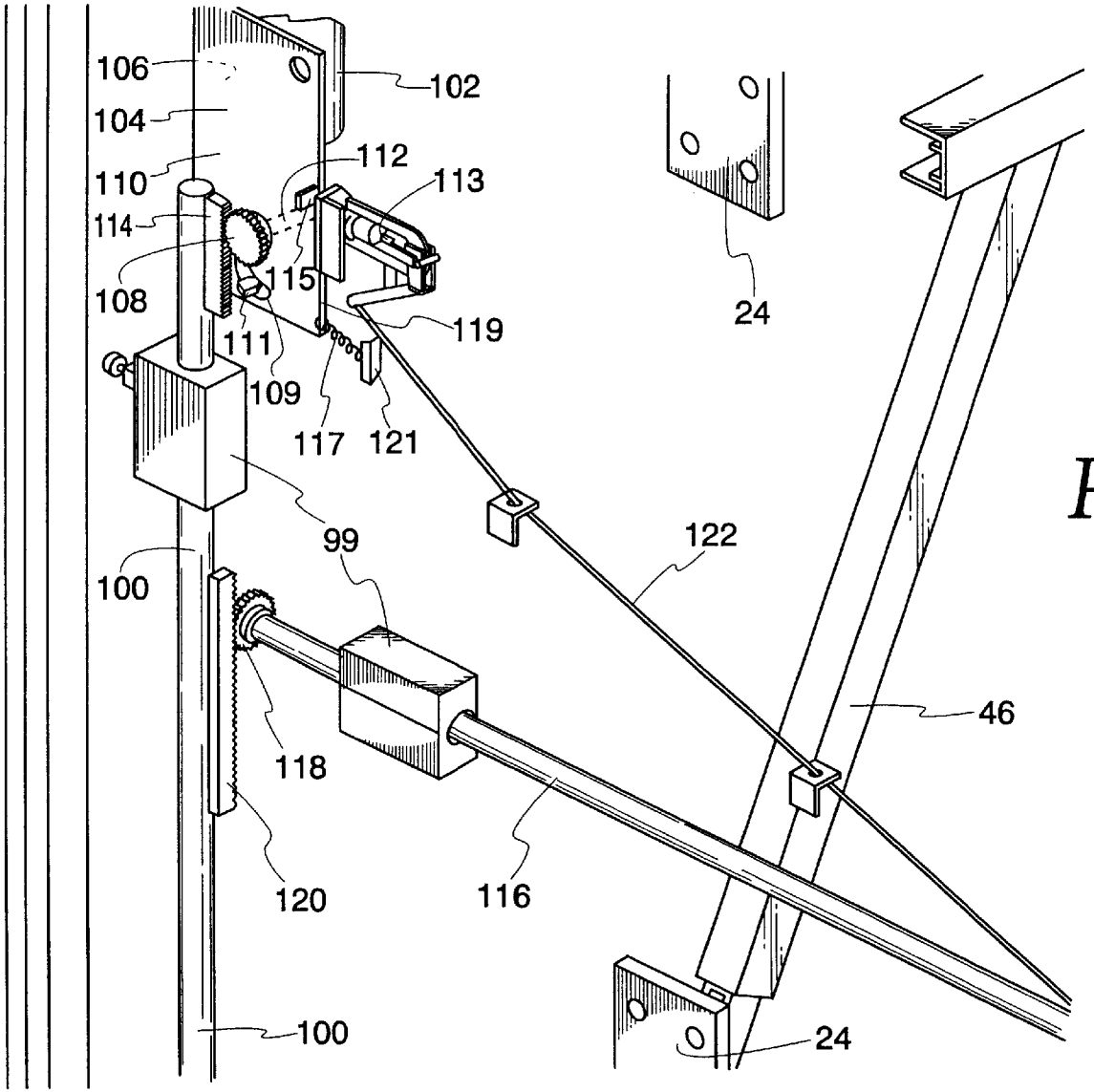
FIG. 7 is a view of FIG. 6 taken along line 7—7.

FIGS. 6 and 7 provide a more detailed depiction of the latch shaft actuating system. For clarification, certain components have been eliminated, including the drive train channel 40 which normally is disposed intermediate the pinch roller 50 and sprocket 36, and the secondary support bracket 22 which normally rests upon its bracket slide 26 and depends therefrom.

Axial actuation of the latch shafts 100 occurs either manually or via a latch shaft motor 102. The motor 102 is mounted onto a latch shaft motor mount 104 which is generally flat in configuration and juxtaposed to one of the latch shafts so that the mount's longitudinal axis is parallel to the longitudinal axis of the latch shaft.

A second surface 110 of the latch shaft motor opposes an exterior surface of the door leaf (the leaf has been eliminated from the drawing for clarity) and slidably communicates with the leaf while remaining co-planer therewith. The point of slidable attachment of the mount 104 to the door leaf is a bolt 111 or rod extending perpendicularly to the mount 104 and extending transversely through the mount at a region of the mount forming a slot 109, whereby the slot has a radius. The radius is configured relative to the latch motor shaft aperture 112. The bolt is anchored to the door leaf, but free to travel within the confines of the slot.

The motor 102 is positioned on a first surface 106 of the mount so as to facilitate rotation of a spur gear 108 which is itself mounted proximal to the opposing, second surface 110 of the latch shaft motor mount 104. The spur gear 108 is arranged so that the plane formed by its periphery is generally parallel to the plane formed by door leaf.

The motor 102 on the first surface 106 communicates with the spur gear 108 via a shaft slidably received through a region of the mount and door leaf which forms a transverse aperture 112. In this configuration, the door leaf 12 is intermediate the second surface 110 of the mount and the spur gear 108.

Intermediate the periphery of the spur gear 108 and an opposing longitudinally extending region of the latch shaft 100 is a gearway 114 itself attached longitudinally to the latch shaft so as to mesh with the periphery of the spur gear 108. Upon actuation by the latch shaft motor 102, the spur gear 108 turns circumferentially to effect a longitudinally extending motion to the latch shaft 100. Reversing the polarity of the motor reverses the direction of extension of the latch shaft so as to selectively slidably engage or disengage the latch shaft 100 with a region of the door jamb (not shown) forming an aperture.

The action of the latch shaft which is proximal to the latch shaft motor assembly is coordinated with a latch shaft distal to the motor assembly via a cross latch drive shaft 116 situated intermediate the proximal and distal latch shafts and generally perpendicular to the two latch shafts 100. Each end of the cross latch drive shaft 116 terminates with spur gears 118. The peripheries of these spur gears 118 are mated with cross latch drive shaft gear ways 120 positioned on the shafts at approximately a 90 degree angle relative to the gearway 114 juxtaposed to the latch shaft motor 102. As such, upon actuation of the proximal latch shaft, the cross latch drive shaft serves to actuate the distal drive shaft in an identical manner.

Figure 8:
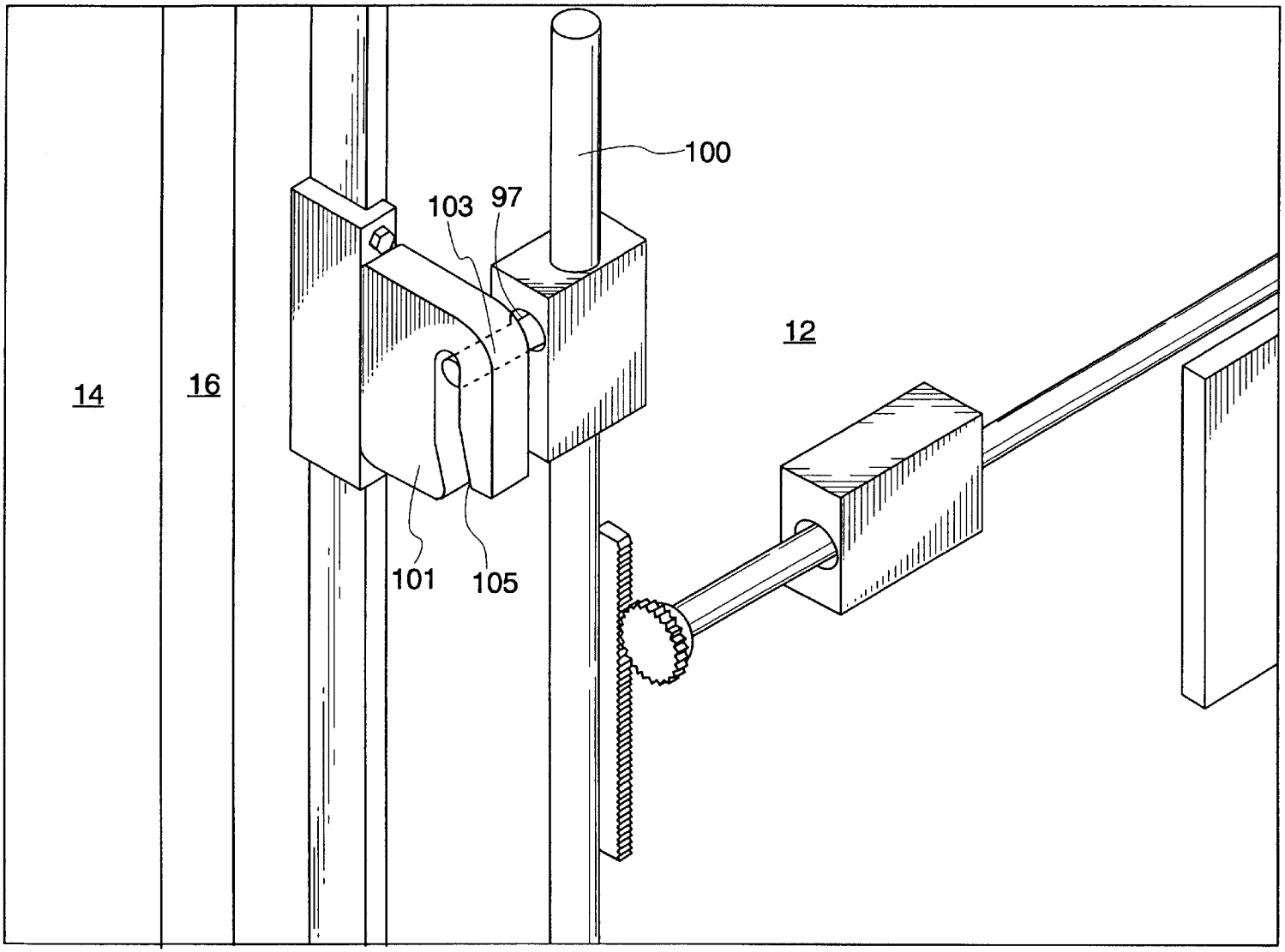
FIG. 8 is a view of FIG. 5 taken along line 8—8.

FIG. 8 is a view of FIG. 5 taken along line 8—8 and depicts detail of the communication between the latch shaft protuberance 103 adapted to be slidably received by the latch block 101. The view in FIG. 8 depicts the latch shaft 100 engaged with the latch block 101. To engage the latch shaft with the block, the latch shaft is actuated axially and in this case upwardly so as to cause the protuberance 103 to contact a cam surface 105 of the latch block 101 in such a manner so as to be confined by the surface. The cam surface 105 extends generally inwardly along the longitudinal axis of the latch block but also deviates laterally from the longitudinal axis so as to cause the protuberance to travel along the cam surface and toward the wall 14 of the enclosure 16 defining the door jamb. This action causes the entire door to move perpendicularly to, and toward the door jamb to effect a more complete seal with the door jamb. It is this additional perpendicular action of the door leaf toward the plane of the door jamb that necessitates the linear carriage 62 and linear way 64 configuration on the first motor mount platform 56, in as much as such perpendicular action (relative to the plane defined by the door jamb) can vary as much as a few inches once the door leaf is positioned by the door leaf actuating motor 34. In essence, and as noted supra, this supplemental, additional perpendicular movement is effected via a second motorized mechanism that is separate from the main door leaf drive mechanism.

To assure precise mating of the protuberance 103 with the cam surface 105, the latch shaft guideways 99 which are juxtaposed medially to the cam surface define a longitudinally extending channel 97 adapted to slidably communicate with the protuberance. As such, the channel 97 accommodates slidable movement of the protuberance relative to the longitudinal axis of the guideway 99 whenever the latch shaft is actuated as described supra.

A safety cord 122 provides for manual decoupling of the motor mount latch shaft gearway 114 from the motor mount spur gear 108. In an engaged configuration, the spur gear mates fully with the gearway 114, via pressure applied laterally onto a peripheral region of the mount 104 by a plunger 115 of a second toggle switch 113. However, when the toggle switch 113 is actuated by the safety cord 122, the plunger 115 of the second toggle lever 113, retracts medially, i.e., in a direction away from the mount 104, thereby resulting in a relaxation of the mating interaction between the spur gear 108 and gearway 114. To more fully retract the spur gear from the gearway, the mount can be spring-based medially at a region of a medial edge 119 of the motor mount plate 104 juxtaposed to a medial end of the slot 109. The spring biasing is effected via a spring 117 attached at one end to the region of the medial edge 119 of the motor mount plate 104, and attached at another end to a stationary point 121 (also depicted on FIG. 6) on the door leaf and in a direction toward the midline of the door leaf.

When the plunger is retracted manually via the safety cord 122, the depending end of the spring biased motor mount plate 104 swings medially, causing a disengagement of the spur gear 108 from the gearway 114. Once disengaged, the door can be unlatched manually.

Latching and unlatching of the door leaf may be effected remotely, again a special advantage in high-radiation, toxic, or otherwise hazardous environments.

Exemplary Embodiment

The method for a dual movement door leaf disclosed herewith is applicable in a myriad different situations. The advantages it provides are most useful where a very thick door is required. This is a case with bank vaults, magnetically shielded enclosures, and especially for anechoic chambers where cones must protrude from the inside face of the door leaf. A hinge-pivoted door is most undesirable in such cases.

A prototype door for an anechoic chamber incorporating the features of this invention has been constructed by the inventors.

A wide variety of materials can be employed in the fabrication of the present invention. For examples, the motors, sprocket wheels, drive chain, rails, glides, and other elements of the device are commercially available and for each of these there are several alternate designs available. The door leaf, carriage, rails, manifold, and other individual components can be manufactured from commonly available ferrous or non-ferrous elements and compounds, including but not limited to steel, aluminum, brass, copper, mu-metal, plastic, glass, composites, and other substrates.

In brief, the present invention provides a device for positioning and moving a door leaf perpendicular to and also parallel to the wall defining a jamb of the door. The door is slidably suspended on a first set of rails supported by a carriage. The carriage itself slides on a second set of rails parallel to the wall so that a single channel, a single motor, and a single drive acting on a single drive chain are utilized to cause the leaf first to move perpendicular to the door opening and then parallel thereto as the door is opened and conversely when the door is closed. This action can be reversed so that a door is slid parallel to a plan defined by a doorjamb after first being positioned co-planarly from a point perpendicular to the plane.

The device is designed to be actuated solely by electric power, and does not require pneumatics. Actuation can be effected remotely from a central control panel while feedback information is supplied by a series of roller switches located at different positions along the tracks mating with the main actuating motor 34. This remote actuation confers special advantage in high-radiation, toxic, or otherwise hazardous environments.

While the invention has been described with reference to details of the illustrated embodiment, these details are not intended to limit the scope of the invention as defined in the appended claims.

The embodiment of the invention in which an exclusive property or privilege is claimed is defined as follows:

1. A multi-action door mechanism comprising a) a door jamb defining an opening and a plane;

b) a first set of rails extending generally perpendicular to the plane;

c) a second set of rails extending generally perpendicular to the first set of rails wherein said first set of rails are slidably positioned on said second set of rails;

d) a door leaf slidably mounted on said first set of rails so as to allow the door leaf to move in a direction generally perpendicular to the plane and contact said door jamb;

e) an elongated member which is both parallel and perpendicular to the plane; and f) a single motor attached to said door leaf and engaged with said elongated member so as to move said door leaf in said direction perpendicular to said plane.

2. The door mechanism as recited in claim 1 wherein said motor is electrically actuated.

3. The door mechanism as recited in claim 2 further comprising means to move the door leaf manually.

4. The door mechanism as recited in claim 1 wherein the motor is pneumatically actuated.

5. The door mechanism as recited in claim 1 wherein said motor is hingeably mounted on said door leaf.

6. The door mechanism as recited in claim 1 wherein said door leaf is movable parallel to the plane.

7. The door mechanism as recited in claim 1 wherein the door leaf is suspended.

8. The door mechanism as recited in claim 1 wherein said elongated member is stationary.

9. A double acting door assembly comprising:

a) a door leaf slidably mounted on a first set of rails and defining a first plane;

b) a second set of rails perpendicular to the first set of rails, wherein the first set of rails is slidably positioned on the second set of rails;

c) a door jamb adapted to receive said door leaf, said door jamb defining a second plane;

d) an elonaated member perpendicular to and parallel to said second plane;

e) a motor attached to said leaf and which engages said elongated member to move said leaf perpendicular to the second plane and parallel to the second plane while maintaining the door leaf parallel to the second plane.

10. The door assembly as recited in claim 9 wherein said elongated member is stationary.

11. The door assembly as recited in claim 10 wherein the elongated member extends perpendicularly from the second plane for a predetermined distance and parallel to the second plane for a predetermined distance.

12. The door assembly as recited in claim 10 wherein the motion of the door leaf is determined by a longitudinal axis of the elongated member.

13. The door assembly as recited in claim 9 wherein the leaf is suspended.

14. The assembly door as recited in claim 9 wherein the motor is pneumatically actuated.

15. The door assembly as recited in claim 9 wherein the motor is electrically actuated.

16. A double acting door assembly comprising:

a) a door leaf slidably mounted on a first set of rails and defining a plane;

b) a second set of rails perpendicular to the first set of rails, wherein the first set of rails is slidably positioned on the second set of rails;

c) an elongated member having a longitudinal axis extending perpendicular to and parallel to the plane; and d) a motor attached to said leaf and which engages said elongated member to move said leaf along the longitudinal axis.

17. The door assembly as recited in claim 16 wherein said elongated member is stationary.

18. The door assembly as recited in claim 16 wherein the motor is hingeably mounted on said leaf.

19. The door assembly as recited in claim 16 wherein the door leaf is suspended from said first set of rails.

* * * * *

UNITED STATES PATENT AND TRADEMARK OFFICE

CERTIFICATE OF CORRECTION

PATENT NO. : 6,209,264 B1
DATED : April 3, 2001
INVENTOR(S) : Garth D'Abreu

It is certified that error appears in the above-identified patent and that said Letters Patent is hereby corrected as shown below:

Column 10,
Line 56, after word "an," delete "elonaated," and insert word -- elongated --.

Signed and Sealed this

Second Day of October, 2001

*Attest:*

Nicholas P. Godici

*Attesting Officer*

NICHOLAS P. GODICI
*Acting Director of the United States Patent and Trademark Office*